United States Patent [19]

Lamlee

[11] 4,346,900

[45] Aug. 31, 1982

[54] GAME BOARD AND DICE USABLE THEREWITH

[76] Inventor: Stewart Lamlee, 55 W. 86th St., New York, N.Y. 10024

[21] Appl. No.: 181,190

[22] Filed: Aug. 25, 1980

Related U.S. Application Data

[63] Continuation of Ser. No. 893,756, Apr. 5, 1978, abandoned.

[51] Int. Cl.[3] ..... A63F 3/00; A63F 9/04

[52] U.S. Cl. ..... 273/274; 273/146

[58] Field of Search ..... 273/142 E, 146, 274; D21/21, 32, 34, 35, 37

[56] References Cited

U.S. PATENT DOCUMENTS

| | | | |
|---|---|---|---|
| D. 55,858 | 7/1920 | Gagnon | D21/35 |
| 1,445,891 | 2/1923 | Johnson | 273/274 X |
| 1,481,628 | 1/1924 | Souza | 273/146 |
| 3,850,434 | 11/1974 | Ockenfels | 273/274 |
| 3,904,208 | 9/1975 | Grossman | 273/274 X |
| 3,977,679 | 8/1976 | Magiera | 273/146 X |

FOREIGN PATENT DOCUMENTS 982535 2/1965 United Kingdom ..... 273/146

OTHER PUBLICATIONS

"Scarne's Complete Guide to Gambling", Copyright 1961 by Simon & Shuster, pp. 242–245,, 258–259.

"Tripoley", 1970 Cadaco Catalog.

*Primary Examiner*—Harland S. Skogquist

*Attorney, Agent, or Firm*—Brian L. Ribando

[57] ABSTRACT

A game which may be played by two or more persons includes a playing board and a pair of dice. The board comprises three concentric play areas, the outer two of which are divided into arcuate sections. The central play area designates a type of dice which is to be used with the particular game board. The various play areas are provided with indicia to indicate an appropriate payoff rate to be associated with that area. A number of variations of the game board are possible, each of which is to be played with particularly shaped dice.

1 Claim, 8 Drawing Figures

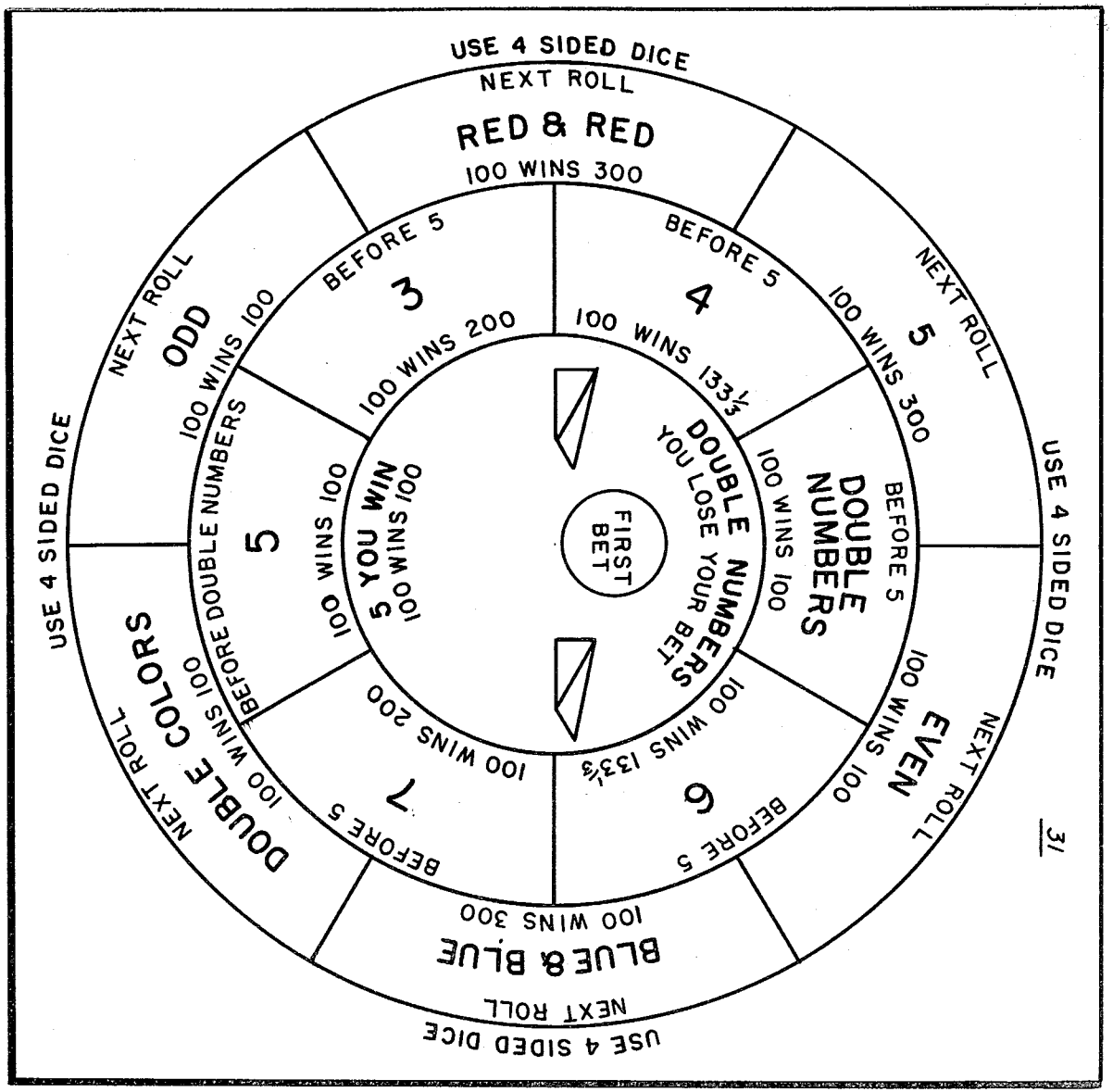
Fig_4
Fig_3
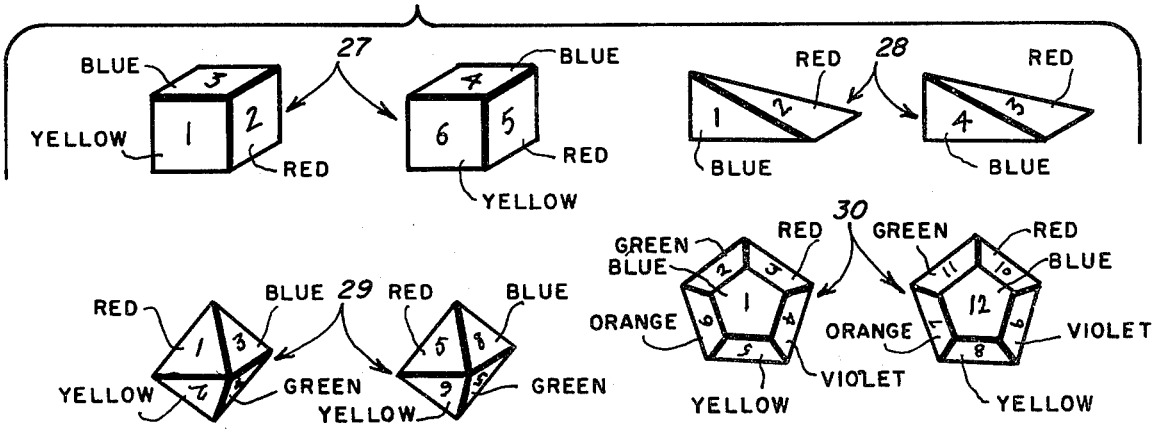

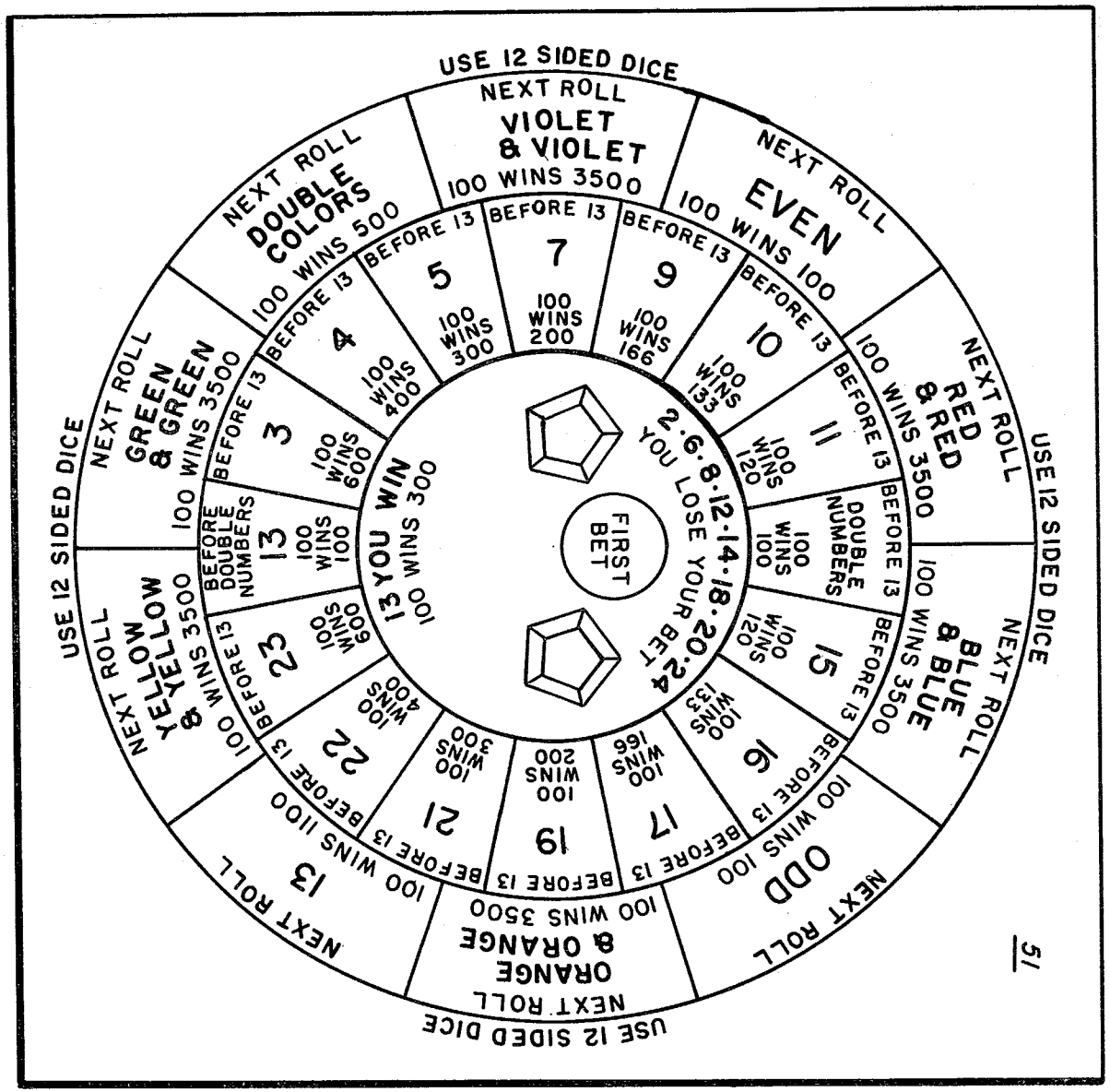
51
USE 12 SIDED DICE
NEXT ROLL
RED & RED
100 WINS 3500
NEXT ROLL
BLUE & BLUE
100 WINS 3500
NEXT ROLL
ODD
100 WINS 100
USE 12 SIDED DICE
NEXT ROLL
ORANGE & ORANGE
100 WINS 3500
NEXT ROLL
13
100 WINS 1100
NEXT ROLL
YELLOW & YELLOW
100 WINS 3500
NEXT ROLL
GREEN & GREEN
100 WINS 3500
NEXT ROLL
DOUBLE COLORS
100 WINS 500
USE 12 SIDED DICE
NEXT ROLL
VIOLET & VIOLET
100 WINS 3500
NEXT ROLL
EVEN
100 WINS 100
BEFORE 13
DOUBLE NUMBERS
100 WINS 100
BEFORE 13
DOUBLE NUMBERS
100 WINS 100
2·6·8·12·14·18·20·24
YOU LOSE YOUR BET
FIRST BET
13 YOU WIN
100 WINS 300
BEFORE 13
100 WINS 100
BEFORE 13
100 WINS 100
BEFORE 13
100 WINS 100

GAME BOARD AND DICE USABLE THEREWITH

This is a continuation of copending U.S. Application Ser. No. 893,756, filed Apr. 5, 1978, now abandoned.

BACKGROUND AND SUMMARY OF THE INVENTION

The invention relates to a board game which is played with dice. Two or more players may participate in the game, and each player is provided with a number of playing chips furnished by a bank. The playing board is divided into three concentric play areas, the inner one of which indicates a type of dice which is to be used with that particular board. The player who is to roll the dice places his chips as a bet in the inner play area. Other players place their chips as bets in the various segments of the outer and middle play areas. The outcome of the rolled dice is determinative of the payoff on the bets which were placed. Lost bets are collected by the bank, and won bets are paid by the bank to the players. Bets which are neither won nor lost may be left on the board for the next roll of the dice, or may be removed as each player desires. Several variations of the game comprise different game boards, each of which is uniquely associated with a type of dice having a certain number of sides. Until the present time, no such game has been known in the prior art.

BRIEF DESCRIPTION OF THE DRAWINGS

FIG. 3 shows differing die shapes which are to be used with the various game boards.

FIGS. 4–8, respectively show various embodiments of the game boards which are to be used with the differing shaped dice pairs, and variations thereof.

DETAILED DESCRIPTION OF THE INVENTION

Figure 1:
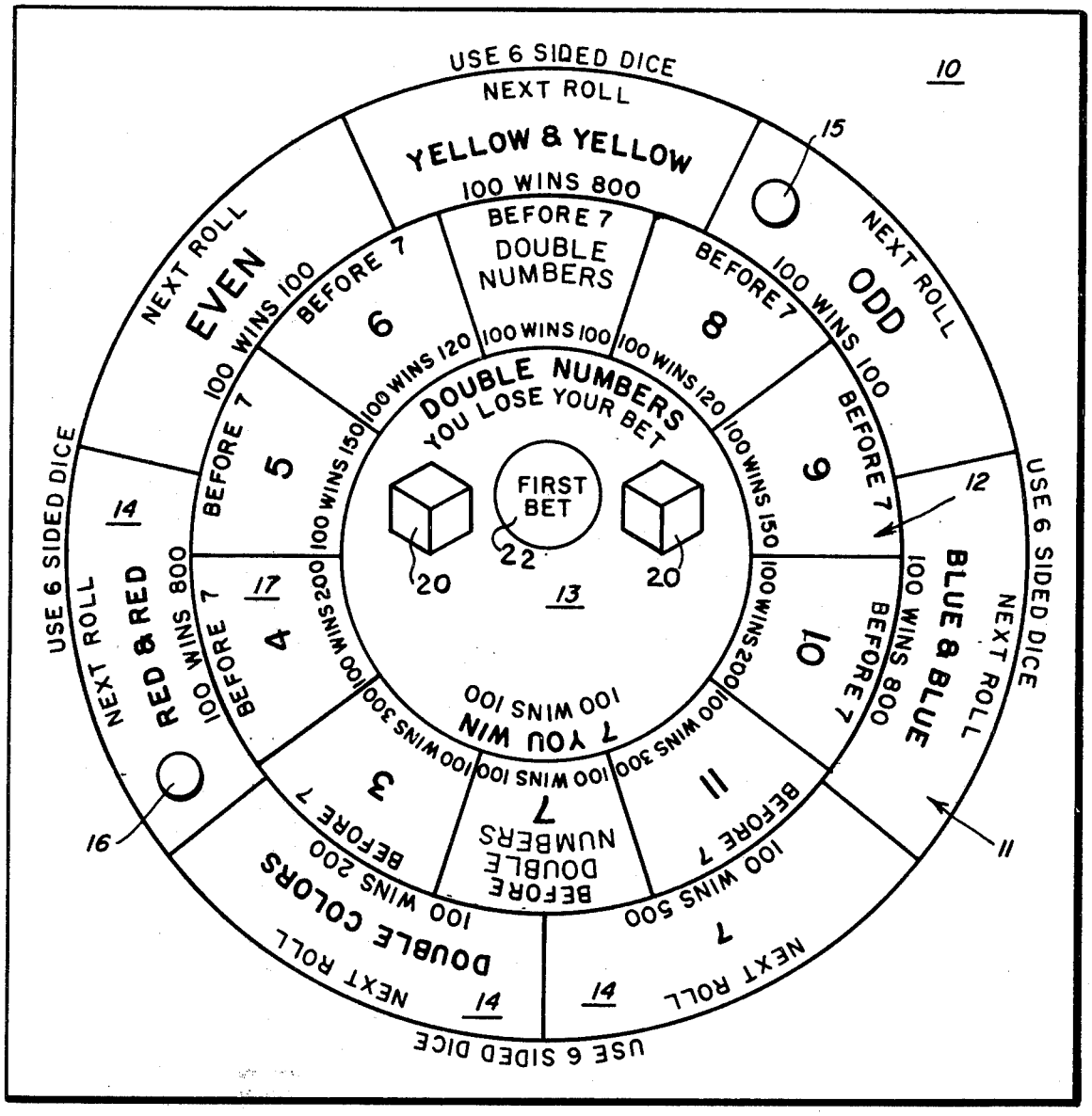
FIG. 1 shows a game board which is used when playing with six-sided dice.

Referring first to FIG. 1, there is shown a game board 10 which may be used in playing the game of the instant invention. The board displays three concentric playing areas 11, 12 and 13. The outer area 11 is divided into a plurality of arcuate playing segments 14, each of which is provided with suitable indicia. During game play, the players place chips such as chips 15 and 16 in chosen ones of the arcuate segments 14. The chips are assigned a value of 100 for computing purposes. Chips which are placed as bets on the outer ring 11 are either won or lost according to the outcome of the next roll of the dice after the chips have been placed. Each section identifies the winning outcome and the amount that the player wins for each chip value of 100 that the player has bet. All players, including the player that is rolling the dice, may at any time prior to actually rolling the dice, place chips on any section of the outer (or middle) ring regardless of whether or not another player is also betting on that outcome.

The middle ring 12 is divided into a plurality of arcuate segments 17 upon which bets or chips may be placed. Bets on the middle ring are won if the indicated desired outcome occurs before the indicated undesired outcome. If the undesired outcome occurs first, that bet is lost. If neither outcome occurs, the chip remains and may be removed by the player who has placed the bet before the next roll of the dice. If the player does not remove the chip, the chip is considered as having been placed for the next roll of the dice.

As an example of this aspect of the game play, in the game which is played on the board of FIG. 1, a pair of six-sided dice, indicated at 20, are used. On this board, the middle ring 12 has nine sections 17 in which a player will win if the desired outcome occurs before a 7 is rolled. There is one section in which the desired outcome is 7 and the undesired outcome is any double number such as 4 and 4, or 5 and 5, etc.

The central area 13 of the board is a circular area which displays the shape of the dice which are to be used in game play. The area 13 also includes an off-center circular area 22 marked FIRST BET together with the rules for winning and losing the first bet. It will be noted that dice 20 are shown as six-sided cubes.

Figure 2:
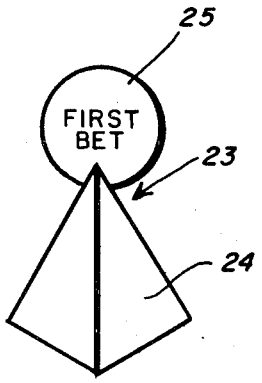
FIG. 2 shows a marker which is used in game play.

Turning now to FIG. 2, a bet marker 23 having the shape of a pyramid 24 surmounted by a disc 25 is shown. The marker is used, as explained more fully below, to indicate the first bet which is placed by the player who is to cast the dice. In the event that this bet is neither won nor lost, in accordance with the instructions in the central area 13, the chips which comprise the first bet are moved from area 22 to another area on the board. The bet marker 23 moves with the chips and identifies these chips as the first bet.

Turning now to FIG. 3, various forms of dice which may be used in game play are shown. The pair of dice 27 have six sided and are provided with indicia on the sides thereof. The indicia takes the form of numerals which appear on the die faces. The die faces are also colored as is shown.

As a general rule, each die is colored so that the two opposite faces have the same color. Also, the opposite faces are numbered so that when added together, they equal 1 plus the number of faces of the die. Therefore, the die faces displaying the numerals 1 and 6 are opposite one another and are yellow. Those displaying the numerals 2 and 5 are opposite one another and are red. Those displaying the numerals 3 and 4 are opposite one another and are blue. The pair of dice 27 are to be used with the game board of FIG. 1.

A secoond pair of dice 28 is also shown. The dice comprising this pair each have four sides which display numerical indicia. As indicated, those faces displaying the indicia 1 and 4 are blue, while those faces displaying the indicia 2 and 3 are red.

A third pair of dice 29 are shown, each die of this pair having eight sides which display numerical indicia. As indicated, those faces displaying the indicia 1 and 8 are green, those faces displaying the indicia 2 and 7 are yellow, those faces displaying the indicia 3 and 6 are blue, and those faces displaying the indicia 4 and 5 are red. A fourth pair of dice 30 are shown, each die of this pair having twelve sides which display numerical indicia. As indicated, those faces displaying the indicia 1 and 12 are blue, those displaying the indicia 2 and 11 are green, those displaying the indicia 3 and 10 are red, those displaying the indicia 4 and 9 are violet, those displaying the indicia 5 and 8 are yellow, and those displaying the indicia 6 and 7 are orange.

Figure 5:
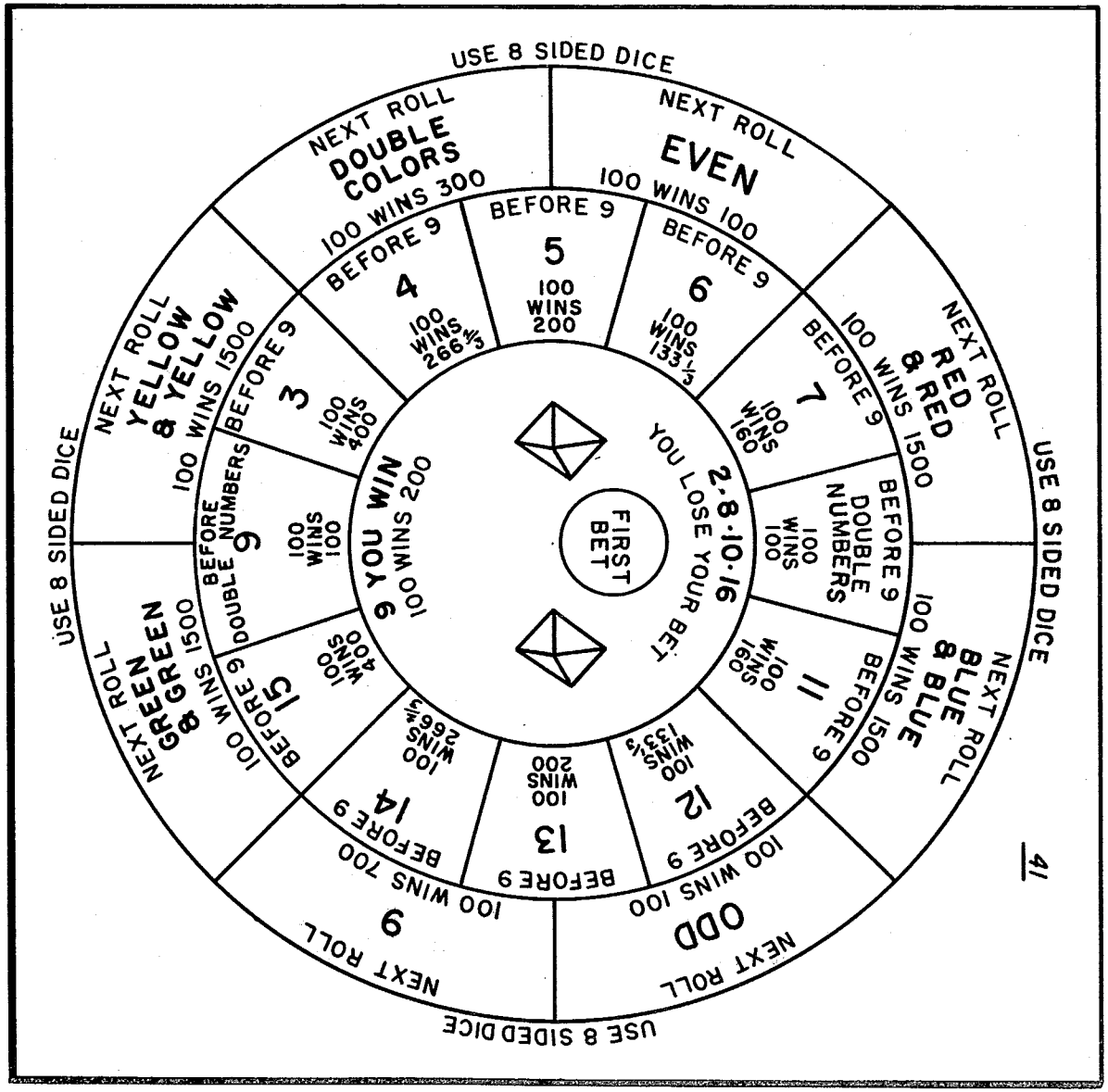

The pairs of dice 28–30 are each adapted to be used with game boards which are similar to but are variations of the game board of FIG. 1. Specifically, the four-sided dice of dice pair 28 are to be used with the game board 31 shown at FIG. 4. The eight-sided dice of dice pair 29 are to be used with the game board 41 shown at FIG. 5.

The twelve-sided dice of dice pair 30 are to be used with the game board 51 shown at FIG. 6.

Typical game play with the board 10 of FIG. 1, the bet marker 23 of FIG. 2, and the dice pair 27 of FIG. 3 proceeds as indicated below. A player who is to cast the dice places chips which constitute a bet in the area marked FIRST BET. The dice marker 23 is placed on top of these chips. The player with the dice and all of the other players may then place their chips which constitute bets on any section of the middle ring 12 and the outer ring 11. The player with the dice pair 27 then rolls the dice. The outcome of the roll is announced by a player who is termed the "Banker." The Banker may be any of the players or a person whose function it is only to operate the bank. All chips which constitute losing bets are collected by the Banker for the bank. This is not to be confused with the Banker's own finances. All chips which constitute winning bets remain on the board and payment is made by the bank by placing the appropriate number of chips on top of each winning bet.

If the player with the dice has either won or lost the first bet, the dice are handed to the next player in turn and that player again makes a first bet. If the player with the dice has neither won nor lost the first bet, then that bet, together with the dice marker 23 is moved from the first bet area to the appropriately numbered section of the middle ring. For example, in the game which uses a pair of six-sided dice, an 8 may be rolled which does not consist of double numbers (4,4). Such a bet does not win or lose according to the instructions within the playing area 13. The first bet with the dice marker is therefore moved to the arcuate segment 17 marked with a large "8" in the middle ring 12 which states "8 BEFORE 7." This first bet may not be changed by the player with the dice without forfeiting the dice to the next player in turn. Additional bets on the same section by any player, including the player with the dice, are permitted.

The number rolled on the dice to determine the outcome of the first bet is called the "Point." The player with the dice in subsequent rolls tries to "make the point" by rolling the same number as the Point. The player with the dice attempts to make the point until either the Point is made or the undesired outcome which is stated in the section that designates the Point has occurred. If the player makes the Point, that player wins the amount indicated in the section of the middle ring 12 with the same number as the Point. If the undesired outcome occurs before the Point has been made, the player with the dice loses that bet. Upon winning or losing, the player transfers the dice to the next player in turn. Before each roll of the dice, whether it be a First Roll of the dice or subsequent rolls of the dice by any player, all of the players are given an opportunity to place whatever bets they desire, up to a convenient limit per player, on any section of the middle or outer ring. Each player may place several bets at a time.

All bets placed must be of unites of 100 (a whole chip) or multiples thereof. No fractional bets are permitted. Payoffs with a fractional component, however, are permitted. For example, "100 wins $133\frac{1}{3}$." In such a case, the fractional chips ($33\frac{1}{3}$) must be paid by the bank. These fractional chips are to be accumulated by the player until they are redeemed for whole chips (100) or cash. It should be understood that while a description of the game has been made with the six-sided dice 27 used in conjunction with the game board 10 of FIG. 1, the game play on the boards of FIGS. 4, 5 and 6, with the dice pair 28, 29 and 30, respectively, is conducted in the same manner.

The boards of FIGS. 1, 4, 5 and 6 display regulatory indicia for game play in which the return for a winning bet is based upon fair odds. Under these conditions, there is no bias toward the bank or toward the players. The rules for paying a winning bet may be altered, however, so that an advantage to the players or to the bank is given. There are various methods which may be used to alter the game boards of FIGS. 1, 4, 5 and 6 to change the game played thereon from one having fair odds to one one having biased odds.

Figure 7:
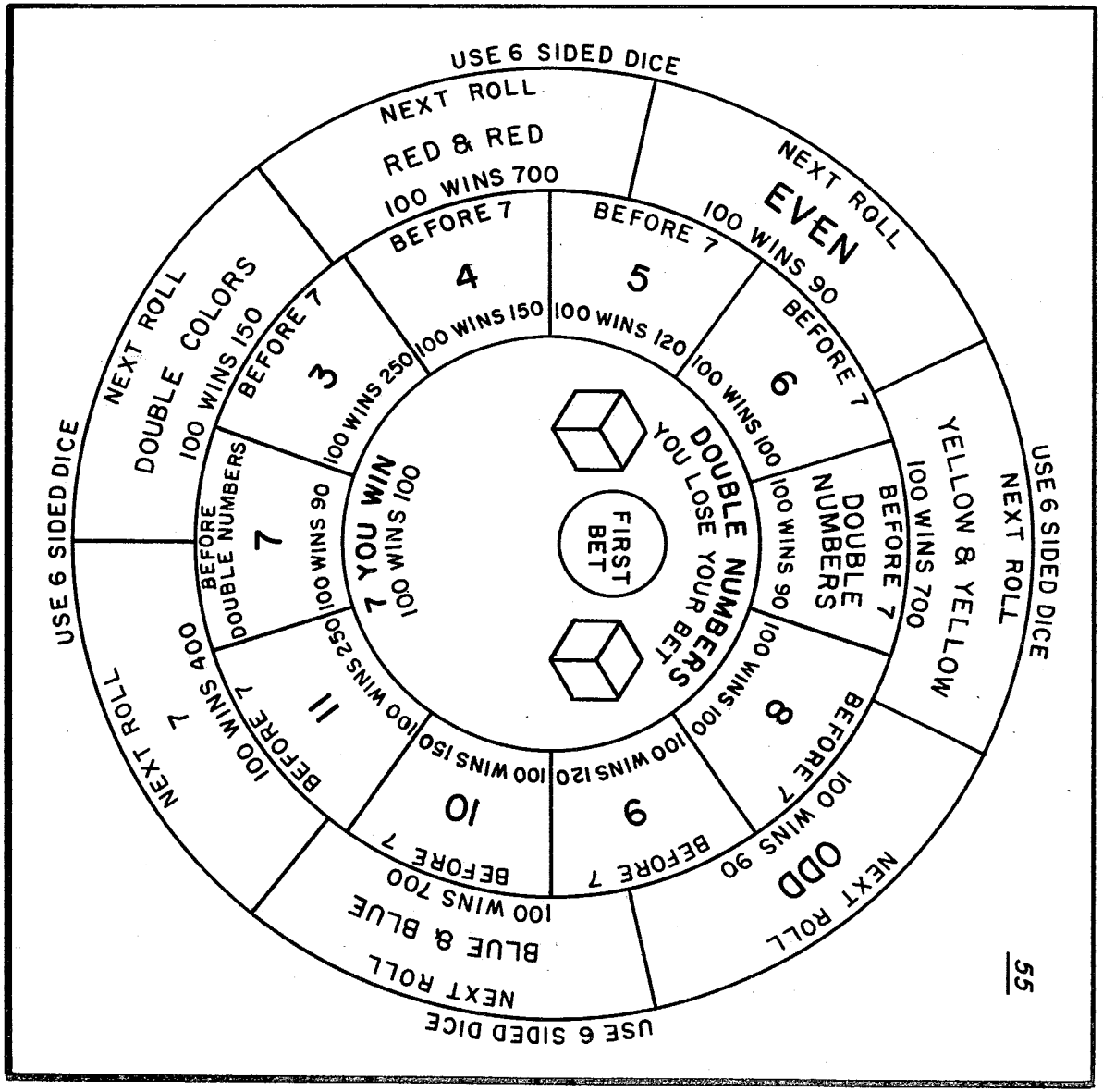

FIG. 7 shows a game board 55 in which the odds are biased to be in favor of the bank. This biasing is effected by the indicia on the board which indicates the payoff made by the bank in the event of a win. The game board 55 is to be used in conjunction with six-sided dice as dice pair 27. As indicated on the board, a roll of, for instance, yellow and yellow, is paid off by the bank in accordance withh the instruction, "100 wins 700." The identical instruction is indicated where a roll of the dice yields a blue and blue, or a red and red dice face combination. The even chance of rolling a red and red combination with the dice pair 27 is 1 in 9. Where a player is returned his bet after a winning roll and the return is 7 for 1 on a probability which is 1 in 9, the Bank achieves a 1 in 9 advantage.

Figure 8:
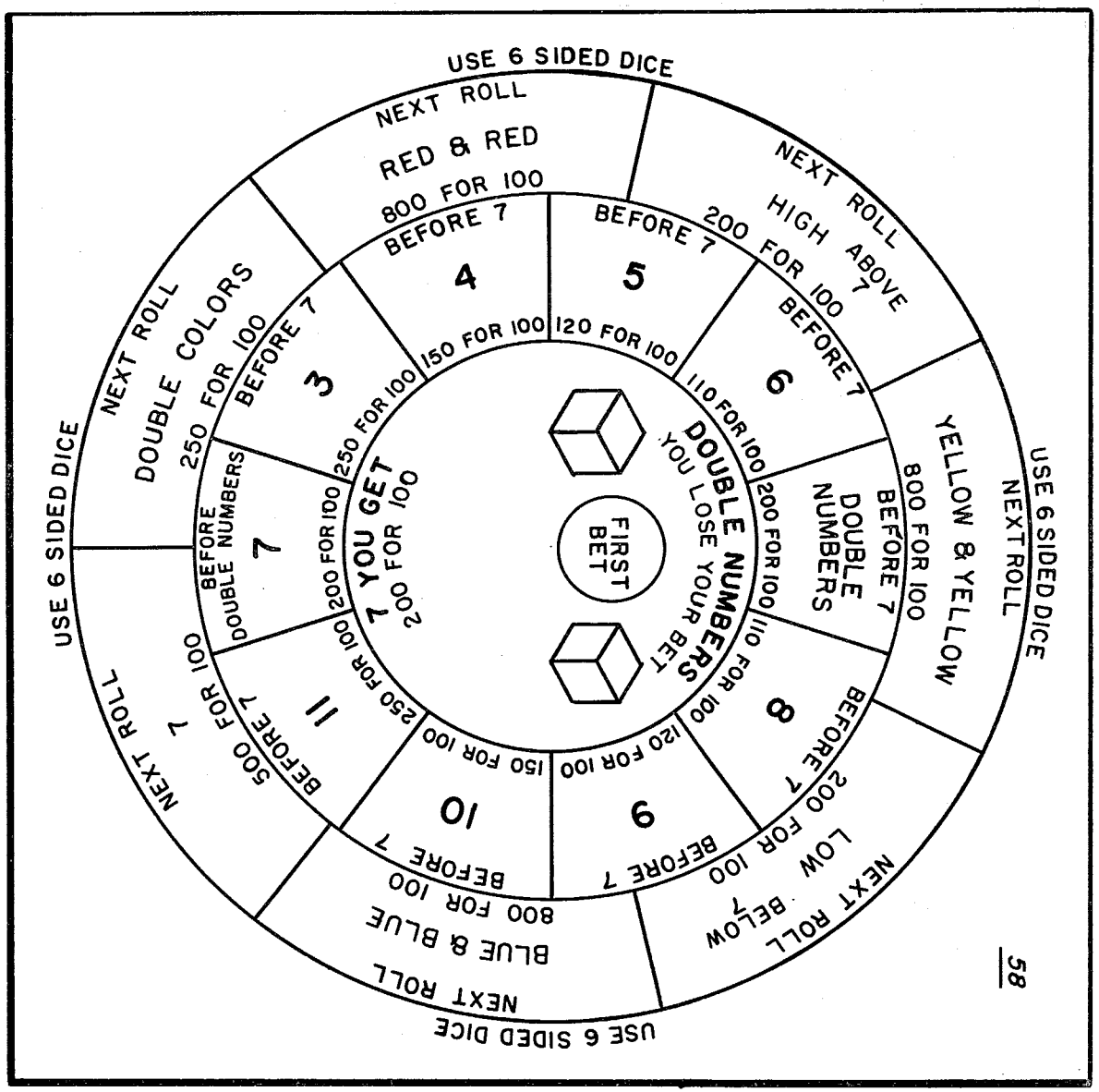

An alternative embodiment of a Bank biased playing board is shown at FIG. 8. Again, the payoff given by the Bank on a winning bet is less than the odds in an unbiased game would dictate. On the board 58, for example, a roll of yellow and yellow is paid in accordance with the instruction, "800 for 100". The odds for such a roll is 1 in 9, but the payoff is 8 for 1, giving the Bank a slight bias. When paying a winning bet following the instruction "800 for 100", the original 100 bet is retained, and 800 is given to the player.

Having thus described the invention, various modifications thereof will occur to those skilled in the art, which modifications are intended to be within the scope of the invention as defined in the appended claims.

I claim:

1. In a game apparatus for two or more players, the apparatus comprising:

a game board comprising a central circular playing area, a middle annular playing area surrounding the central circular playing area, and an outer annular playing area surrounding the middle annular playing area, a pair of dice, numerical indicia on the faces of each die and color indicia on the faces of each die, wherein the color indicia on the opposite faces of a single die are the same and wherein the color indicia on adjacent faces of a single die are different, a plurality of pairs of dice, each pair comprising dice shaped differently than the other pairs, die shape indicating means on the game board defining the shape of the dice to be used with the game board, a first series of arcuate segments comprising the middle annular playing area, and first means on each of the first series of arcuate segments indicating a winning outcome determined by numerical indicia displayed on the upturned faces of cast dice, a second series of arcuate segments comprising the outer annular playing area, second means on the second series of arcuate segments indicating a winning outcome determined by color indicia displayed on the upturned faces of cast dice, and third means on the second series of arcuate segments indicating a winning outcome determined by numerical indicia displayed on the upturned faces of cast dice, chips for marking a bet in the middle annular playing area and in the outer annular playing area, first bet marking means for marking a first bet in the central circular playing area, and fourth means on the central circular playing area indicating if the first bet is won or lost, said second means on the second series of arcuate segments indicating the placement of the first bet marking means if the first bet is neither won nor lost.

* * * * *